US011123781B2

(12) United States Patent
Krueger et al.

(10) Patent No.: US 11,123,781 B2
(45) Date of Patent: Sep. 21, 2021

(54) ROLL STAND, ROLLING SYSTEM AND METHOD FOR ACTIVELY DAMPING VIBRATIONS IN A ROLL STAND

(71) Applicant: SMS Group GmbH, Duesseldorf (DE)

(72) Inventors: Matthias Krueger, Hilchenbach (DE); Sebastian Richard, Siegen (DE); Karsten Rues, Hilchenbach (DE); Michael Breuer, Hilchenbach (DE)

(73) Assignee: SMS GROUP GMBH, Duesseldorf (DE)

( * ) Notice: Subject to any disclaimer, the term of this patent is extended or adjusted under 35 U.S.C. 154(b) by 256 days.

(21) Appl. No.: 15/762,199

(22) PCT Filed: Aug. 18, 2016

(86) PCT No.: PCT/EP2016/069568
§ 371 (c)(1),
(2) Date: Mar. 22, 2018

(87) PCT Pub. No.: WO2017/050493
PCT Pub. Date: Mar. 30, 2017

(65) Prior Publication Data

US 2018/0290191 A1 Oct. 11, 2018

(30) Foreign Application Priority Data

Sep. 23, 2015 (DE) ..... 102015218251.7
Nov. 27, 2015 (DE) ..... 102015223516.5

(51) Int. Cl.
*B21B 13/02* (2006.01)
*B21B 37/00* (2006.01)
*B21B 38/00* (2006.01)

(52) U.S. Cl.
CPC ..... *B21B 13/02* (2013.01); *B21B 37/007* (2013.01); *B21B 38/008* (2013.01); *B21B 2013/025* (2013.01); *B21B 2203/44* (2013.01)

(58) Field of Classification Search
CPC ..... B21B 13/02; B21B 37/007; B21B 37/66; B21B 38/008; B21B 2013/025; B21B 2203/44; B21B 31/30; B21B 31/20; B21B 38/105
See application file for complete search history.

(56) References Cited

U.S. PATENT DOCUMENTS 6,373,171 B1 * 4/2002 De Lange ..... B21B 37/58 310/328
6,519,994 B1 * 2/2003 Quambusch ..... B21B 31/185 72/237

(Continued)

FOREIGN PATENT DOCUMENTS

DE 10254958 A1 * 6/2004 ..... B21B 37/58
EP 0483939 A1 * 5/1992

(Continued)

OTHER PUBLICATIONS

Machine Translation of DE-10254958-A1, Markus, Publication Year 2004, Total Pages 12 (Year: 2020).*

*Primary Examiner* — Teresa M Ekiert
*Assistant Examiner* — Sarkis A Aktavoukian
(74) *Attorney, Agent, or Firm* — Abelman, Frayne & Schwab; Stefan Knirr

(57) ABSTRACT

The invention relates to a roll stand (2) for rolling, in particular cold-rolling, metal products, comprising at least one actuator (16) which can be actuated for actively damping vibrations in the roll stand (2), and at least one supporting roll (10) which is non-adjustable or can be adjusted exclusively via a readjusting device for pass line adjustment (13) of the roll stand (2) for supporting a working roll (5) and/or intermediate roll of the roll stand (2), wherein the supporting roll (10) is guided at the ends via a respective (Continued)

Figure 1:
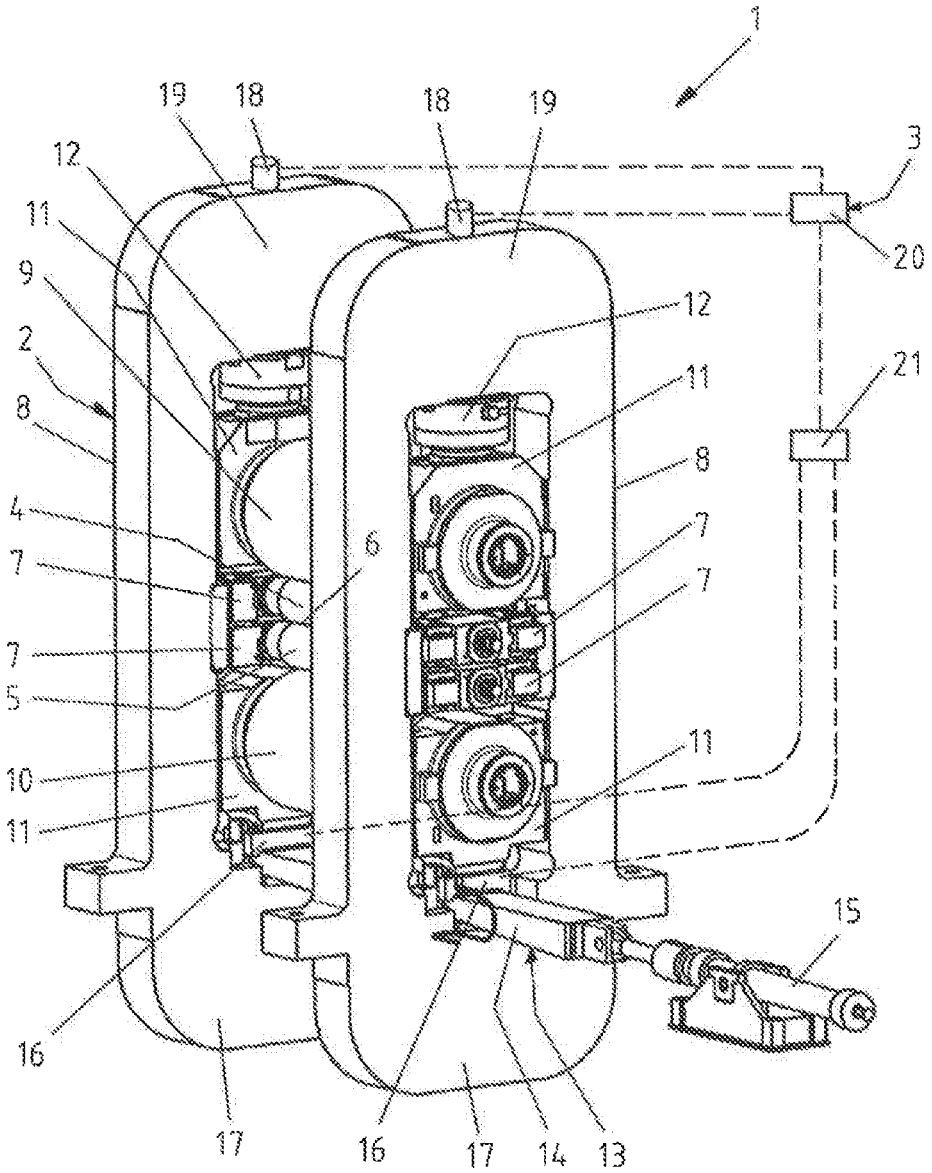

bearing unit (11) on a rack (8) of the roll stand (2). In order to enable an optimal active damping of vibrations in a roll stand (2) of this type with low engineering effort, the invention proposes that the supporting roll (10) is supported on the actuator (16) via at least one bearing unit (11) and that the actuator (16) is supported on a section (17) of the rack (8) either directly or indirectly via at least one component (14) of the readjustment device (13).

18 Claims, 2 Drawing Sheets

(56) References Cited

U.S. PATENT DOCUMENTS

| | | | | |
|---|---|---|---|---|
| 6,763,694 | B1 | 7/2004 | Boulton | |
| 2003/0070466 | A1* | 4/2003 | Horii | B21B 31/103 72/229 |
| 2011/0120202 | A1* | 5/2011 | Hohenbichler | B21B 37/007 72/7.1 |
| 2016/0318083 | A1 | 11/2016 | Del Tedesca | |

FOREIGN PATENT DOCUMENTS

| | | | |
|---|---|---|---|
| EP | 1457274 | | 9/2004 |
| EP | 1457274 | A2 * | 9/2004 |
| EP | 1961992 | | 8/2008 |
| EP | 2052796 | | 4/2009 |
| JP | H05228504 | A * | 9/1993 |
| JP | H08247211 | A * | 9/1996 |
| SU | 820952 | | 4/1981 |
| SU | 1158260 | | 5/1985 |

* cited by examiner

ROLL STAND, ROLLING SYSTEM AND METHOD FOR ACTIVELY DAMPING VIBRATIONS IN A ROLL STAND

RELATED APPLICATIONS:

This application is a National phase application of PCT/EP2016/069568 filed Aug. 18, 2016 and claiming priority of German applications DE 102015218251.7 and DE 102015223516.5 filed, respectively, Sep. 23, 2015 and Nov. 27, 2015, all three applications are incorporated herein by reference thereto.

The invention relates to a roll stand for rolling, preferably cold-rolling, metal products, comprising at least one actuator which can be actuated for actively damping vibrations in the roll stand, and at least one supporting roll which is nonadjustable or can be adjusted exclusively via a readjustment device for pass line adjustment of the roll stand for supporting a working roll and/or intermediate roll of the roll stand, wherein all the rolls are guided at the ends via a respective bearing unit on a rack of the roll stand.

The invention moreover relates to a rolling system for rolling, preferably cold-rolling, metal objects, comprising at least one roll stand and at least one system for actively damping vibrations in the roll stand.

The invention furthermore relates to a method for actively damping vibrations in a roll stand for rolling, preferably cold-rolling, metal products, wherein the vibrations in the roll stand are acquired and counter-vibrations counteracting the vibrations are generated, wherein the counter-vibrations are generated by means of at least one actuator.

In four-high cold-rolling stands and six-high cold-rolling stands, different vibration phenomena occur, which negatively influence the rolling process carried out and the quality of the cold-rolled metal product, metal strip in particular. In the cold-rolling of certain aluminum grades and steel grades, so-called $3^{rd}$ octave and $5^{th}$ octave chatter vibrations are particularly characteristic, which are named in accordance with their vibration frequency in the respective musical octave position ($3^{rd}$ octave: 110 Hz-220 Hz, $5^{th}$ octave: 440 Hz-880 Hz).

The 5th octave chatter vibrations as a rule denote the eigenmodes of the roll set of a roll stand in the frequency range between 500 Hz and 1000 Hz, which are excited by external stimuli (so-called "forcing functions"), such as, for example, rotational speed-proportional excitation frequencies from rolling bearings and/or from the rolls or tooth engagement frequency of gear stages. These cause surface and/or shape defects in the rolled metal product, defects which are oriented mainly transversely to the product or strip running direction.

In comparison, the third octave chatter vibration denotes a self-excited vibration mode which can also lead to thickness defects oriented transversely to the product or strip running direction and subsequently to strip cracks in the case of high amplitudes. The instability is generated here due to the fact that a certain eigenmode of the complete roll set in the roll stand is destabilized by a system-inherent feedback in the rolling process. The chatter-relevant eigenmode of the roll stand as a rule is the one at which an upper and a lower roll set in the roll stand vibrate essentially against one another. As a result, a high energy potential exists for the stimulation of this vibration mode from the rolling gap. The frequency of this eigenmode is usually between 80 Hz and 160 Hz. The destabilized feedback (positive feedback) is generated by the rolling process itself due to the fact that changes in the intake speed, which are caused by changes in the exit thickness, cause variations of the intake traction due to the law of mass flow, which in turn react(so-called feedback effect) upon the rolling force and thus in turn influence the exit thickness.

The generation mechanisms as well as the technological effects of the 3rd octave and 5th active chatter vibrations are essentially known and have been described in the relevant literature. Their effects on the quality of the rolled metal product with regard to thickness, flatness and surface as well as on the production performance due to increased strip cracking rates and reduced rolling speeds even today still affect the production of cold-rolled steel strip and cold-rolled aluminum strip to a considerable extent.

Since the two racks of a roll stand are barely involved in the vibration modes of the $5^{th}$ octave chatter and since the roll set of the roll stand should be designed based on the limiting conditions resulting from the respective rolling work, the possibilities for reducing or preventing these vibration modes are very limited. In order to prevent the self-excited $3^{rd}$ octave chatter vibrations which, via the limitation of the maximum rolling speed, limit the production performance of rolling systems having multiple stands, several approaches exist, which include, in addition to optimization of the pass schedule and process parameters increasing passive damping, for example, by friction, as well as methods for active damping. The two first-mentioned approaches have the disadvantage that thereby the limit chatter speed, that is to say the rolling speed at which the stability limit for the self-excited $3^{rd}$ octave chatter vibration is reached, can as a rule be increased only by relatively small amounts, for example, 50 m/min-200 m/min. In many cases, the maximum possible system speed cannot be achieved by these approaches.

Several methods for actively damping 3rd octave chatter vibrations are indicated in the pertinent literature. For example, EP 2 052 796 A1 discloses such a method, according to which pressure changes are generated directly in a pressure chamber adjoining a piston of a hydraulic cylinder which sets the rolling gap. For this purpose, on the pistons, several small pistons are axially movably guided, which can be actuated via linear actuators.

WO 2015/092775 A1 discloses an additional method for actively damping vibrations in a roll stand. For this purpose, hydraulic actuators are used, which act on bearing units of rolls for the active damping of vibrations, bearing units via which the rolls are guided on a rack of the roll stand. On each hydraulic setting member, a piezoelectric injector is arranged, which is inserted directly into the pressure chamber of the hydraulic setting member. The damping effect is generated by high-pressure oil injection into the hydraulic setting units.

An aim of the invention is to enable an optimal active damping of vibrations in a roll stand with low engineering effort.

This aim is achieved by the independent claims. Advantageous designs are indicated, in particular, in the dependent claims which, taken alone or in different combination with one another, can represent an aspect of the invention.

An inventive roll stand for rolling, preferably cold-rolling, metal products comprises at least one actuator which can be actuated for actively damping vibrations in the roll stand, and at least one back-up roll which is non-adjustable or can be adjusted exclusively via a wedge adjustment of the roll stand for supporting a working roll or intermediate roll of the roll stand. The back-up roll is guided at its ends via a respective bearing unit on a rack of the roll stand. According to the invention, the back-up roll is supported on the actuator via at least one bearing unit, and the actuator is supported on a section of the rack either directly or indirectly via at least one readjustment device for pass line adjustment, for example, for a wedge adjustment, so that the actuator thus lies in the main force flow of the roll stand.

Due to the active damping of the vibrations in the roll stand by means of the actuator, in particular 3rd octave and 5th octave chatter vibrations can be eliminated. Thereby, vibration-caused quality losses with regard to thickness, flatness and surface on the rolled, in particular cold-rolled, metal product, in particular steel strip or aluminum strip, can be avoided. In addition, due to the active vibration damping, the productivity and the rolling speed can be increased. Thereby, system speeds requested by clients and contractually promised can be reliably achieved and even exceeded.

Moreover, the active damping makes it possible to reduce the maintenance expenditures and intervals, since it reduces the effects of the above-mentioned external stimuli on product quality. I.e., for a constant product quality, a system state that is worse with regard to excitation amplitudes is acceptable with active damping in comparison to what would be acceptable without active damping.

The invention relates to a simple, cost-effective, easily integrated and retrofitable solution, in particular if the actuator is arranged at the installation site of a conventional load cell on the roll stand. In this case, practically no structural changes need to be made on a roll stand for the integration of the actuator. Therefore, the invention can be implemented both in the course of retrofitting operations on existing roll stands and also in new roll stands. In contrast, the solution proposed with EP 2 052 796 A1 is relatively complicated, expensive and maintenance-intensive.

Conventional solutions for active damping of vibrations in a roll stand usually work together with setting members of a technological control of a level automation, for example for bending/flatness control. Thereby, possibly important setting members for the control of product quality can be affected by a device or control for active damping of vibrations. In the invention, this is not the case, since the actuator of the inventive roll stand does not work together or is not combined with corresponding setting members.

Another disadvantage of the incorporation of piezo hydraulic actuators in hydraulic control units as proposed, for example, by WO 2015/092775 A1, is the viscous behavior of the hydraulic oil used. In spite of the high system pressure, usually more than 200 bar, the hydraulic oil has an elasticity which must be taken into consideration for the overall action of the system. In the invention, this is not necessary, since the actuator of the inventive roll stand is not incorporated in a corresponding hydraulic control unit.

In addition, for the incorporation of known solutions in a rack window of a rack of a roll stand, usually only limited installation space is available. This is particularly the case in the immediate proximity of the rolling gap as well as in the area of roll bending systems, of a roll cooling and of a blowing off. When, in addition, the temperature situation in the roll stand and the heat production of a piezo actuator itself are considered, additional thermal problems can arise for the above-mentioned installation sites in the proximity of the rolling gap. These problems do not occur in the invention, since the actuator of the inventive roll stand is not arranged atone of the above-mentioned installation sites.

The inventive roll stand can also comprise two or more corresponding actuators which can be actuated jointly or individually for actively damping the vibrations in the roll stand. The actuation of the actuator or of the actuators can occur, for example, electrically.

The supporting roll can either be non-adjustable or can be adjusted exclusively via a readjustment device for pass line adjustment of the roll stand. The wedge adjustment serves for the pass line adjustment of the back-up roll and of the working roll supported thereby, which is achieved by means of a transversely directed displacement of the adjusting wedge of the wedge adjustment. The working roll supported with the back-up roll optionally via the intermediate roll works together with an additional working roll of the roll stand, wherein a rolling gap is present between these working rolls. The additional working roll and optionally intermediate roll can also be supported with an additional back-up roll and can be guided displaceably on the rack together with the back-up roll for setting the rolling gap by means of at least one adjustment device, in particular a mechanical or hydraulic adjustment device. The back-up rolls and the working rolls and optionally intermediate roll are in each case guided at the ends via a respective bearing unit on the rack.

According to the invention, the back-up roll which is non-adjustable or can be adjusted exclusively via the wedge adjustment of the roll stand is supported on the actuator via one end-side bearing unit or via the two end-side bearing units. If the back-up roll is non-adjustable, the actuator is supported preferably directly on the section of the rack. If the supporting roll can be adjusted exclusively via the wedge adjustment of the roll stand, the actuator is supported on a section of the rack preferably indirectly via at least one adjusting wedge of the wedge adjustment.

According to an advantageous design, the actuator is a piezomechanical actuator or a piezohydraulic actuator. The actuator is preferably formed as a compact or installation space-saving module which, as desired, is equipped with a piezomechanical actuator system or a piezohydraulic actuator system. The piezomechanical actuator system is based on piezoceramic transducers which are integrated directly in the mechanical structure of the system which is capable of vibrating and which directly introduce dynamic forces there. In contrast, the piezoceramic transducers of a piezohydraulic actuator system act indirectly on the system via additional hydraulic transducers. In both cases, via an electronic actuation of the piezoceramic transducers, the necessary mechanical setting amplitude (force/displacement) is generated. Via a piezomechanical actuator, dynamic forces can be introduced in a frequency range of up to 1 kHz, so that, in principle, this technology can be considered for the active damping of both the 3rd octave and also of the 5th octave chatter vibrations. In the context of preliminary theoretical investigations, several possible installation sites for the actuator in the area of the roll stand have been examined and evaluated. The inventive installation site between a bearing unit of the supporting roll and the section of the rack is particularly suitable for the use of a piezo actuator system, since there is high effectiveness here with a view to the active damping of the 3rd octave chatter vibrations in combination with a relatively low actuator volume. In particular, the actuator can be arranged between a lower rack-cross-head and a bearing unit of the supporting roll.

According to an additional advantageous design, the actuator is set up for the acquisition of rolling forces. For this purpose, an existing load cell can be replaced by the actuator. Then, conventional load cells can be dispensed within the installation area, since the actuator takes over the measurement function of a load cell. As measurement principle for the force measurement, one can consider using here either the force measurement via the piezo elements used as actuator or the force measurement via a force measurement to be integrated separately in the actuator unit, for example, via strain gauges. A load cell is usually arranged between the readjustment device used for adjustment of the pass line, for example, a wedge adjustment, and a bearing unit of a back-up roll. Due to the omission of load cells, a cost saving can be achieved.

According to an additional advantageous design, the roll stand comprises at least two corresponding actuators, wherein the bearing units of the supporting roll are supported on a respective actuator, and the two actuators in each case are supported on a section of the rack either directly or indirectly via at least one readjustment device for the pass line adjustment. Thus, for each roll stand, two actuators can be used, wherein one actuator can be arranged on a drive-side rack and one actuator can be arranged on an operation-side rack of the roll stand.

An additional advantageous design provides that the roll stand comprises at least one vibration sensor arranged on the rack, for acquiring the vibrations of the roll stand. The vibration sensor can be set up for acquiring vibrations in vertical direction. With the vibration sensor, it is possible to acquire the 3rd octave and 5th octave chatter vibrations in particular. The roll stand can also comprise two or more vibration sensors. The use of two vibration sensors for each roll stand is sufficient for acquiring the described vibration phenomena with sufficient precision and for providing corresponding vibration signals.

Advantageously, the vibration sensor is arranged, with regard to a rolling gap formed between cooperating working rolls of the roll stand, on a section of the rack which is arranged opposite the section of the rack on which the actuator or the adjusting wedge is supported. The vibration sensor can be mounted, for example, on an upper rackcross-head of the rack of the roll stand. The roll stand can have two racks arranged spaced apart from one another in transverse direction, on the respective rackcross-head of which a vibration sensor is arranged in each case.

Preferably, the vibration sensor is set up to acquire vibrations in a frequency range from approximately 0.5 Hz to approximately 2000 Hz. Thereby, by means of the sensor, in particular the 3rd octave and the 5th octave chatter vibrations but also other vibrations which affect the quality of the rolled material can be acquired.

Moreover, it is advantageous if the vibration sensor is an acceleration sensor. By means of the acceleration sensor, accelerations in vertical direction can be acquired in particular.

An inventive rolling system for rolling, preferably cold-rolling, metal objects comprises at least one roll stand and at least one system for actively damping vibrations in the roll stand, wherein the roll stand is formed according to one of the above-mentioned designs or any combination thereof. The system comprises at least one control electronics unit connected by signal technology to the vibration sensor and to the actuator, by means of which vibration signals generated by the vibration sensor can be evaluated for the generation of control signals, and which is set up to actuate the actuator for the introduction of counter-vibrations in the roll standby means of the respective control signals.

The advantages mentioned above in reference to the roll stand are accordingly associated with the rolling system. The rolling system can also comprise two or more corresponding roll stands, with which in each case a separate system for actively damping vibrations in the roll stand is associated. Alternatively, a single common system for actively damping vibrations in the roll stand can be associated with the roll stands. In particular, the rolling system can be a single- or multi-rack steel or aluminum cold-rolling system. The system can comprise a control system and a signal amplifier connected thereto by signal technology for amplifying the control signals.

The active damping of vibrations can thus comprise at least one vibration sensor, via which the vibrations in the roll stand can be measured, at least one actuator which imparts a counter-vibration to the roll stand to be damped at an appropriate site, as well as a control system which calculates the counter-vibration necessary for eliminating the vibrations at the site of interest in the roll stand, in terms of frequency, amplitude and phase, and prepares them for the actuation of the actuator. From the standpoint of control technology, the reduction of the vibration amplitude via the application of a counter-vibration can also be interpreted as a (controlled) increase in damping, wherefore one speaks of "active damping."

According to an advantageous design, the control electronics is set up for the online monitoring of the vibrations of the roll stand, for the online visualization of vibration levels of the vibrations of the roll stand, for the automatic start-up of at least one low-vibration rolling speed and/or for the automatic reduction of an instantaneous rolling speed as a function of the instantaneously acquired vibrations of the roll stand. The monitoring and visualizing of the vibrations in the roll stand enables a visual control and a possible intervention in a rolling process by the operating personnel. The automatic start-up of suitable low-vibration rolling speed ranges serves to improve the rolling result or the product quality. The automatic reduction of an instantaneous rolling speed as a function of the instantaneously acquired vibrations of the roll stand (auto-slow-down functionality) is used in particular to prevent strip cracks when 3rd octave chatter vibrations occur. Overall, the control electronics can also consist of several separate modules which are assembled in a system-specific manner.

According to an additional advantageous design, the control electronics is set up to determine frequencies, amplitudes and/or phase positions of the counter-vibrations to be generated. The control electronics can process the vibration signals of the vibration sensor or vibration sensors, in order to calculate an optimal signal form, that is to say the frequency and the amplitude, as well as the phase position of one or more counter-vibrations which are necessary in order to eliminate the respective corresponding undesired vibrations in the roll stand.

An additional advantageous design provides that the control electronics is set up to generate the control signals taking into consideration a transmission behavior of the vibration sensor, of the actuator and/or of a roll stand of the rolling mill. Thereby, the targeted introduction of the counter-vibrations into the roll stand can be improved.

Advantageously, the control electronic system is set up to react to temporal changes of characteristics of the actuator and/or of a controlled system used. Thereby, the control electronics is based on an adaptive control, so that the control can adapt automatically to changed conditions and circumstances, in order to optimize the targeted introduction of the counter-vibrations into the roll stand.

According to an inventive method for actively damping vibrations in a roll stand for rolling, preferably cold-rolling, metal products, the vibrations in the roll stand are acquired and counter-vibrations counteracting the vibrations are generated, wherein the counter-vibrations are generated by means of at least one actuator, wherein the counter-vibrations are introduced into at least one supporting roll which is non-adjustable or can be adjusted exclusively via a wedge adjustment of the roll stand for supporting a working roll or intermediate roll of the roll stand, which supporting roll is supported on the actuator via at least one bearing unit, via which it is guided on a rack of the roll stand, and wherein the actuator is supported on a section of the rack either directly or indirectly via a readjustment device for the pass line adjustment.

The advantages mentioned above in reference to the roll stand and the rolling system are correspondingly associated with the method. In particular, the roll stand or respectively the rolling system can be used for carrying out the method. Advantageous designs of the roll stand and of the rolling system, to the extent that they comprise method features, are advantageous designs of the method, even if this is not explicitly described.

According to an advantageous design, the actuator is used for acquiring rolling forces. The advantages mentioned above in reference to the corresponding design of the roll stand are correspondingly associated with this design.

Figure 2:
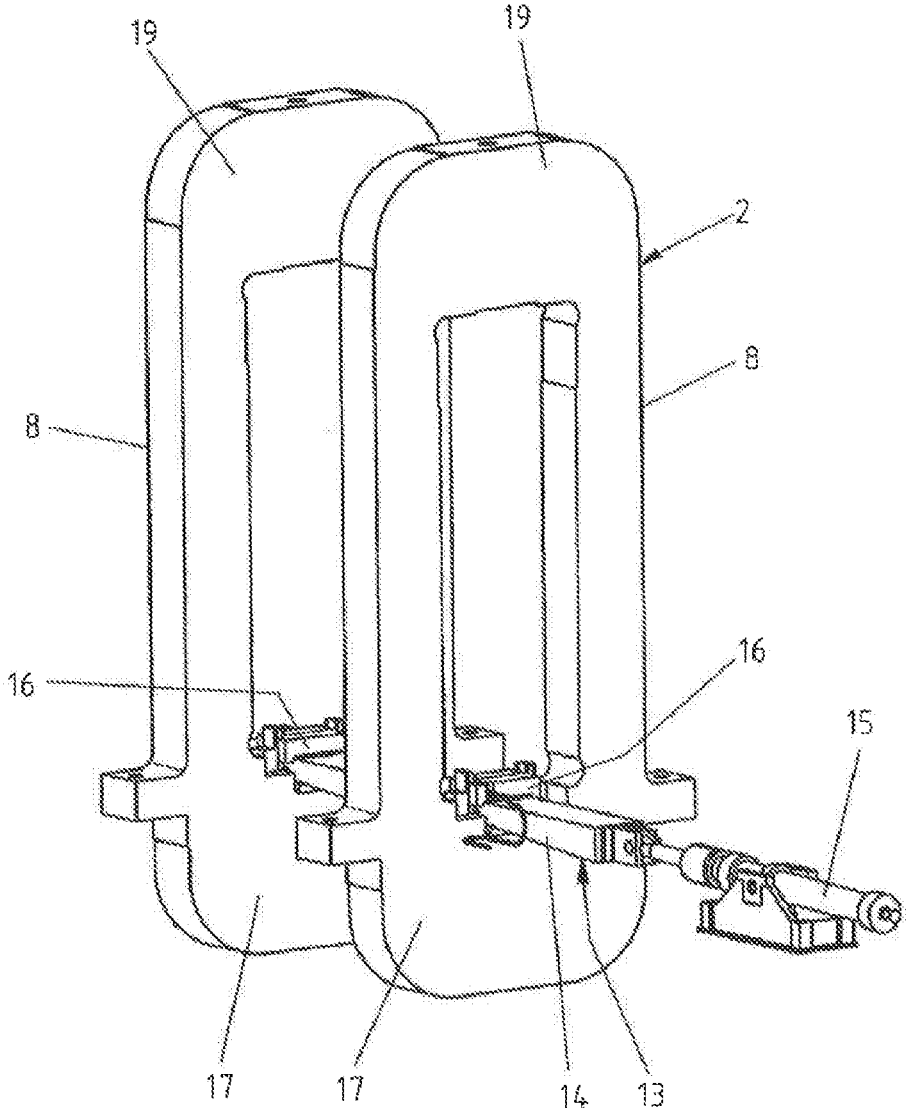

Below, the invention is explained as an example in reference to the appended figures based on a preferred embodiment, wherein the features explained below can represent an aspect of the invention, both taken alone and also in different combination with one another. In the figures:

FIG. 1: shows a diagrammatic and perspective view of an embodiment example for an inventive rolling system; and FIG. 2: shows a diagrammatic and perspective detail view of the roll stand of the rolling system shown in FIG. 1.

FIG. 1 shows a diagrammatic and perspective view of an embodiment example for an inventive rolling system 1 for rolling, in particular cold rolling, metal objects. The rolling system 1 comprises a roll stand 2 and a system 3 for active damping of vibrations in the roll stand 2.

The roll stand 2 comprises an upper working roll 4 and, cooperating therewith, a lower working roll 5, between which a rolling gap 6 is formed. The working rolls 4 and 5 are in each case guided at their ends via a respective bearing unit 7 on a respective rack 8 of the roll stand 2. Moreover, the roll stand 2 comprises an upper back-up roll 9 supporting the upper working roll 4 and a lower back-up roll 10 supporting the lower working roll 5. The supporting rolls 9 and 10 are in each case guided at their ends via a respective bearing unit 11 on a respective rack 8 of the roll stand 2. The roll stand 2 moreover comprises two adjusting units 12 arranged on a respective rack 8, for the adjustment of the upper working roll 4 together with the upper back-up roll 9 and for setting the height of the rolling gap 6. In addition, the adjusting units 12 are used for generating the respective rolling forces. Furthermore, the roll stand 2 comprises a wedge adjustment 13 arranged on the racks 8, with an adjusting wedge 14 and a setting device 15 actuating the adjusting wedge 14.

The roll stand 2 comprises two actuators 16 which can be actuated for active damping of vibrations in the roll stand 2. Moreover, the roll stand 2, as explained above, comprises the lower back-up roll 10 which can be adjusted exclusively via the wedge adjustment 13 of the roll stand 2 for supporting the lower working roll 5 of the roll stand 2. The lower back-up roll 10 is supported via the bearing units 11 in each case on one of the two actuators 16. The actuators 16 are supported indirectly via the adjusting wedge 14 of the wedge adjustment 13 on a section 17 of the respective rack 8, wherein the respective section 17 is a lower rack cross head. Thus, the load cells, not shown, located conventionally at this installation site are replaced by the actuators 16.

The actuators 16 are each formed as a piezomechanical actuator or as a piezohydraulic actuator. The actuators 16 can be set up for acquiring rolling forces, which makes it possible to dispense with conventional load cells.

The roll stand 2 moreover comprises two vibration sensors 18 arranged on a respective rack 8, for acquiring the vibrations of the roll stand 2. Each vibration sensor 18 is arranged with respect to the rolling gap 6 on a section 19 of the respective rack 8 which is arranged opposite the section 17 of the respective rack 8 on which the adjusting wedge 14 is supported. The section 19 is formed by an upper rack cross head of the respective rack 8. Each vibration sensor 18 can be set up to acquire vibrations in a frequency range from approximately 0.5 Hz to approximately 2000 Hz. Each vibration sensor 18 can be an acceleration sensor.

The system 3 comprises a control electronics 20 connected by signal technology to the vibration sensors 18 and to the actuators 16, by means of which control electronics the vibration signals generated by the vibration sensors 18 can be evaluated for the generation of control signals, and which is set up to actuate the actuators 16 for the introduction of counter-vibrations into the roll stand 2 by means of the respective control signals. Moreover, the system 3 comprises a signal amplifier 21 for amplifying the control signals to be supplied to the actuators 16.

The control electronics 20 can be set up for the online monitoring of the vibrations of the roll stand 2, for the online visualization of vibration levels of the vibrations of the roll stand 2, for the automatic start-up of at least one low-vibration rolling speed and/or for the automatic reduction of an instantaneous rolling speed as a function of the instantaneously acquired vibrations of the roll stand 2. Moreover, the control electronics 20 can be set up for determining the necessary frequencies, amplitudes and/or phase positions of the counter-vibrations to be generated. In addition, the control electronics 20 can be set up to generate the control signals taking into consideration a transmission behavior of the vibration sensors 18, of the actuators 16 and/or of a rolling mill of the roll stand 2, which is formed by the rolls 4, 5, 9 and 10. Furthermore, the control electronics 20 can be set up to react to temporal changes of characteristics of the actuators 16 and/or of a controlled system used.

FIG. 2 shows a diagrammatic and perspective detail representation of the roll stand 2 of the rolling system shown in FIG. 1. In particular, the arrangement of the actuators 16 on the adjusting wedge 14 of the wedge adjustment 13 can be seen better, adjusting wedge which is supported on the lower sections 17 of the racks 8. For the rest, to avoid repetitions, reference is made to the above description of FIG. 1.

LIST OF REFERENCE NUMERALS

1 Rolling system
2 Roll stand
3 System
4 Upper working roll
5 Lower working roll
6 Rolling gap
7 Bearing unit
8 Rack
9 Upper supporting roll
10 Lower supporting roll
11 Bearing unit
12 Adjusting unit
13 Readjustment device for pass line adjustment of wedge adjustment type

14 Component of the readjustment device in the form of an adjusting wedge
15 Setting device
16 Actuator
17 Lower section of 8
18 Vibration sensor
19 Upper section of 8
20 Control electronics
21 Signal amplifier

The invention claimed is:

1. A roll stand (2) for cold-rolling metal products, comprising:

a rack for supporting a lower working roll (5) and an upper working roll (4), at least one back-up roll (10) for supporting the lower working roll (5), a readjusting device (13) positioned on a lower section of the rack beneath the at least one back-up roll for pass-line adjustment and for adjusting a height of the at least one back-up roll (10), a working roll adjustment unit mounted at a top section of the rack for selectively forming a gap between the lower and upper working rolls, and at least one actuator (16) mounted on the lower section of the rack for damping vibrations of the roll stand (2), the back-up roll (10) being supported at opposite ends thereof by respective bearing units (11) provided on the rack, wherein the back-up roll (10) is supported on the at least one actuator (16) by at least one of the bearing units (11), and wherein the at least one actuator (16) is supported below the respective bearing unit (11) directly on the lower section (17) of the rack (8) or indirectly on the lower section of the rack by the readjusting device (13).

2. The roll stand (2) according to claim 1, wherein the at least one actuator (16) is a piezomechanical actuator or a piezohydraulic actuator.

3. The roll stand (2) according to claim 1, wherein the at least one actuator (16) is set up for acquiring rolling forces.

4. The roll stand (2) according to claim 1, wherein the at least one actuator includes first and second actuators (16), wherein the respective bearing units (11) of the back-up roll (10) are supported, respectively, on the first and second actuators (16), and the first and second actuators (16) are supported on a respective section (17) of the rack (8) either directly or indirectly via at least one adjusting wedge (14) of the readjusting device (13).

5. The roll stand (2) according to claim 1, further comprising at least one vibration sensor (18) arranged on the rack (8) for acquiring the vibrations of the roll stand (2).

6. The roll stand (2) according to claim 5, wherein the at least one vibration sensor (18) is arranged on a section (19) of the rack (8) which is arranged opposite the lower section (17) of the rack (8).

7. The roll stand (2) according to claim 5, wherein the at least one vibration sensor (18) is set up to acquire vibrations in a frequency range from 0.5 Hz to 2000 Hz.

8. The roll stand (2) according to claim 5, wherein the at least one vibration sensor (18) is an acceleration sensor.

9. A roll stand according to claim 1, further comprising an intermediate roll, wherein the back-up roll supports the intermediate roll.

10. A roll stand according to claim 1, wherein the at least one actuator is supported on an adjusting wedge of the readjusting device (13).

11. A rolling system (1) for cold rolling metal objects, comprising:

at least one roll stand (2) and at least one system (3) for actively damping vibrations in the at least one roll stand, wherein the at least one roll stand (2) comprises:

a rack having a lower working roll (5) and an upper working roll, at least one back-up roll (10) for supporting the lower working roll (5), a readjusting device (13) positioned on a lower section of the rack beneath the back-up roll for pass-line adjustment and for adjusting height of the at least one back-up roll (10), a working roll adjustment unit mounted at a top section of the rack for selectively forming a gap between the lower and upper working rolls, at least one actuator (16) for selectively damping vibrations of the roll stand (2), wherein the back-up roll (10) is supported at opposite ends thereof by respective bearing units (11) provided on the rack, the back-up roll (10) being supported on the at least one actuator (16) by one of the bearing units (11), and the at least one actuator (16) being supported below the respective bearing unit (11) directly on the lower section (17) of the rack (8) or indirectly by at least one component (14) of the readjusting device (13), at least one vibration sensor arranged on the rack (8) for acquiring the vibrations of the roll stand (2), and the at least one system (3) comprising at least one electronic controller in electronic communication with the at least one vibration sensor (18) and with to the at least one actuator (16), wherein vibration signals generated by the at least one vibration sensor (18) are evaluated for generation of control signals, and the at least one electronic controller selectively transmits the control signals to actuate the at least one actuator (16) for introduction of counter-vibrations into the roll stand (2).

12. The rolling system (1) according to claim 11, wherein the at least one electronic controller (20) which is of modular construction is set up for online monitoring of the vibrations of the roll stand (2), for online visualization of vibration levels of the vibrations of the roll stand (2), for the automatic start-up of at least one low-vibration rolling speed, and/or for the automatic reduction of an instantaneous rolling speed as a function of the instantaneously acquired vibrations of the roll stand (2).

13. The rolling system (1) according to claim 11, wherein the at least one electronic controller (20) is set up to determine frequencies, amplitudes and/or phase positions of the counter-vibrations to be generated.

14. The rolling system (1) according to claim 11, wherein the electronic controller (20) is set up to generate control signals taking into consideration a transmission behavior of the at least one vibration sensor (18), of the at least one actuator (16) and/or of the roll stand (2).

15. The rolling system (1) according to claim 11, wherein the at least one electronic controller (20) is set up to react to temporal changes of characteristics of the at least one actuator (16) and/or of a controlled system used.

16. A roll stand according to claim 11, wherein the at least one component (14) of the readjusting device (13) includes an adjusting wedge.

17. A method for actively damping vibrations in a roll stand (2) for cold-rolling a metal product, wherein the vibrations in the roll stand (2) are acquired, and counter-vibrations counteracting the vibrations are generated, the method comprising:

supporting a lower back-up roll on at least one actuator (16) via at least one bearing unit (11) which supports the lower back-up roll on a rack (8) of the roll stand (2), wherein the at least one actuator (16) is supported directly on a lower section (17) of the rack (8) or indirectly on the lower section of the rack via a readjusting device (13);

adjusting a height of the lower back-up roll exclusively with the readjusting device for pass line adjustment of the roll stand (2);

initiating the cold-rolling of the metal product;

generating the counter-vibrations of at least one actuator (16), and introducing the counter-vibrations into the lower back-up roll (10) for supporting a work roll (5) and/or an intermediate roll of the roll stand (2).

18. The method according to claim 17, wherein the at least one actuator (16) is used for the acquisition of rolling forces.

* * * * *